US007133009B2

(12) United States Patent
Kitai et al.

(10) Patent No.: US 7,133,009 B2
(45) Date of Patent: Nov. 7, 2006

(54) CAPACITIVELY SWITCHED MATRIXED EL DISPLAY

(75) Inventors: Adrian H. Kitai, Mississauga (CA); Kenneth A. Cook, Waterloo (CA); William Tait, Waterloo (CA)

(73) Assignee: Nanolumens Acquistion, Inc., Norcross, CA (US)

( * ) Notice: Subject to any disclaimer, the term of this patent is extended or adjusted under 35 U.S.C. 154(b) by 437 days.

(21) Appl. No.: 10/415,994

(22) PCT Filed: Nov. 6, 2001

(86) PCT No.: PCT/CA01/01551

§ 371 (c)(1), (2), (4) Date: Sep. 4, 2003

(87) PCT Pub. No.: WO02/37462

PCT Pub. Date: May 10, 2002

(65) Prior Publication Data

US 2004/0046717 A1 Mar. 11, 2004

Related U.S. Application Data

(60) Provisional application No. 60/245,575, filed on Nov. 6, 2000.

(51) Int. Cl.
*G09G 3/30* (2006.01)

(52) U.S. Cl. ..... 345/76; 345/80; 348/800

(58) Field of Classification Search ..... 348/800–803; 315/169.3

See application file for complete search history.

(56) References Cited

U.S. PATENT DOCUMENTS 3,271,591 A 9/1966 Ovshinsky
3,673,572 A 6/1972 Silva et al.
3,753,231 A * 8/1973 Hilsum ..... 345/76
4,035,774 A * 7/1977 Chang ..... 345/76
4,775,549 A 10/1988 Ota et al.
5,087,858 A 2/1992 Cherry et al.

FOREIGN PATENT DOCUMENTS

JP 46 15463 4/1971
JP 56 153687 11/1981
JP 61 182084 8/1986
JP 2 29082 5/1993

OTHER PUBLICATIONS

K. E. Van Landingham: "Circuit Applications of Ovonic Switching Devices" IEEE Transactions on Electron Devices., vol. ed-20, No. 2, Feb. 1973, pp. 178-187.

(Continued)

*Primary Examiner*—Richard Hjerpe
*Assistant Examiner*—Michael Pervan
(74) *Attorney, Agent, or Firm*—Hill & Schumacher; Lynn Schumacher

(57) ABSTRACT

The present invention provides a multiplexed matrix alternating current electroluminescent display, comprising an array of matrix addressed capacitively switchable electroluminescent pixels, with each capacitively switchable electroluminescent pixel including an electroluminescent pixel and a circuit element connected in electrical series with the electroluminescent pixel. The circuit element is switchable between an electrically insulating capacitive state and an electrically conducting state depending upon a voltage applied across the capacitively switchable electroluminescent pixel. The matrix multiplexed electroluminescent (EL) display with the low capacitance switching device in electrical series with the electroluminescent pixels reduces column displacement currents, thereby reducing power consumption. Refresh times can also be reduced so that the size and resolution of passive matrix electroluminescent displays can be increased.

33 Claims, 13 Drawing Sheets

OTHER PUBLICATIONS

K.E. Van Landingham: "Electroluminescent Display Matrix With Ovonic Threshold Switch Isolation" Proceedings of the SID., vol. 12, No. 4, 1971, pp. 180-191.
W.E. Howard: "Electroluminescent Display Technologies and Their Characteristics" Proceedings of the SID., vol. 22, No. 1, 1981, pp. 47-56.
G.K. Zin and others: "A Solid-State Matrix-Addressed Display" IEEE Transactions on Electron Devices, vol. ed-12 No. 12, 1965, pp. 632-637.
R. Vogel et al.: "Negative capacitance in amorphous semiconductor chalcogenide thin films" Applied Physics Letters, vol. 14, No. 7, Apr. 1, 1969, pp. 216-218.

* cited by examiner

Parallel Plate Capacitor $C = \epsilon_0 \epsilon_r A/d$

CAPACITIVELY SWITCHED MATRIXED EL DISPLAY

CROSS REFERENCE TO RELATED APPLICATIONS

This patent application is a National Phase application claiming the benefit of PCT/CA01/01551 filed on Nov. 6, 2001; which further claims priority benefit of U.S. provisional patent application No. 60/245,575 filed on Nov. 6, 2000.

FIELD OF THE INVENTION

The present invention relates to alternating current (AC) thin film electroluminescent (EL) displays in which the customary passive matrix addressing scheme is enhanced to increase the size and resolution of panel that can be addressed.

BACKGROUND OF THE INVENTION

Electroluminescence (EL) is a well-known technology for flat panel display applications. An EL display is a thin, solid-state device, which includes a phosphor layer and dielectric layer(s) sandwiched between two electrodes. Upon application of a voltage above a certain threshold value to the electrodes, the phosphor layer emits light. A specific type of EL device for display applications that has been commercially successful since the early 1980's is called alternating current (ac) thin film EL. It has the advantage of being stable, with respect to operating time, and can provide high contrast images since the phosphor layer, being a thin film, is transparent. High contrast is achieved since ambient light does not scatter off the phosphor layer as it would from a powder phosphor device. The details of ac thin film EL devices are discussed in Electroluminescent Displays, Y. A. Ono, World Scientific ISBN 981-02-1921-0 (1995).

FIGS. 1(*a*) and (*b*) show a cross section of a typical EL display device and a cross section of a single pixel. A transparent glass substrate is coated with transparent electrodes (Indium Tin Oxide (ITO) is commonly employed). A first insulating layer is formed on top of the ITO, and a phosphor layer follows. For example, in commercially available EL displays the EL phosphor layer is ZnS:Mn. A second insulating layer follows, and finally a rear electrode is applied to complete the structure. Aluminum (Al) is commonly employed.

In operation, ac voltages in the form of alternating positive and negative voltage pulses are applied between the ITO and Al electrodes generating high electric fields in the phosphor layer. Above a threshold voltage, on the order of ±185 volts, the phosphor layer emits a light pulse substantially synchronized with the leading edge of the voltage pulse. Below this critical voltage, the phosphor layer still experiences electric fields, but the electric field is not sufficient to generate light in the phosphor layer, and so the EL device is in its dark or off state.

The structure of FIG. 1(*a*) also shows that in an EL display device, a plurality of ITO and a plurality of Al electrodes are created in the form of orthogonal stripes. We shall refer to the ITO stripes as columns and the Al stripes as rows. An EL display therefore contains a light emitting phosphor layer, which may be caused to light up in a desired spatial pattern. This is achieved by applying suitable voltages to the various rows and columns.

The intersection of the areas of any one row and any one column as shown in FIG. 1(*b*) incorporating the EL materials structure constitutes an EL pixel. This is the smallest light emitting element that can be controlled in the EL display. If there are N rows and M columns, then there will exist a total of N×M pixels. An example of monochromatic EL display constitutes N=480 (rows) and M=640 (columns) resulting in 480×640=307,200 pixels. This is known as a VGA format display. A full color VGA display would require 3×640 columns, since each pixel comprises three sub-pixels corresponding to red, green, and blue color emission.

In order to form an image in a practical EL display, an economical method of applying voltages to the N rows and M columns is employed. This is known as the matrix multiplex drive method or passive matrix addressing. Each row and each column is connected to a switchable voltage source. Solid-state semiconductor driver devices are commercially available that constitute the switchable voltage sources.

Consider the diagram of FIG. 2. The rows and columns of an EL display are represented by horizontal and vertical lines. The intersections of these lines represent the pixels of the EL display. Each pixel may be uniquely distinguished by identifying the numbers assigned to the row and to the column to which it belongs.

In order to create an image on the EL device, a sequence of events takes place very quickly such that the human eye cannot perceive the sequence of events, but sees the outcome which is a desired spatial pattern of lit and dark pixels which forms the image.

A number of EL drive methods have been developed (See Ono pages 100–111) which include a field refresh drive method, a p-n symmetric drive method and a p-p symmetric drive method. For illustrative purposes, a simple drive scheme is now described. To start with, all row voltages are set to 0 V. Firstly, the M pixels in row 1 of the EL display are addressed as follows: The M columns are set to voltages by the column drivers. These column voltages are either +25 volts or −25 volts, say, for the purpose of illustration. The column drivers are represented by switches in FIG. 2. The pixels that are to be "on" are assigned +25 volts, and the pixels that are to be "off" are assigned −25 volts on their respective columns and the difference between the two is called the modulation voltage, in this case 50 volts. Once this has been done, a high voltage row pulse is applied to row 1 only. The pulse is negative 200 volts, say. The row drivers are represented as switches in FIG. 2. The effect of this is to cause the pixels whose columns are at −25 volts to remain dark since the pixel voltage is the difference between row and column voltage or −200−(−25)=−175 volts. This is below the threshold voltage for the EL device which is assumed to be ±185 volts for illustrative purposes. On'the other hand, those pixels whose columns are +25 volts will emit a light pulse since the pixel voltage is now −200−25=−225 volts, which exceeds the threshold voltage by −40 volts.

The voltage on row 1 now returns to zero and then a new set of voltages is applied to the M columns. These voltages are once again either +25 volts or −25 volts, however the choice is governed by the information to be supplied to the pixels in row 2 of the EL display. The pixels in row 2 that are to be lit must now be supplied with 25 volts and the pixels that are to be dark are supplied with −25 volts. Once these column voltages have been established, a −200 volt pulse is applied to row 2 only and the appropriate pixels in row 2 will be lit. This row voltage then returns to zero.

The same sequence of events as described for pixels of rows 1 and 2 now applies to the remaining rows until all N rows have received one −200 volt pulse in sequence and every lit pixel has been provided with −225 volts and every dark pixel has been provided with −175 volts. At this point, the addressing sequence is half completed. This is called one frame.

Next, the columns are set to +25 or −25 volts to re-address the pixels of row 1 of the EL display. However this time the pixels to be lit are set to −25 volts and the dark pixels are set to +25 volts. Once these column voltages are present, a +200 volt row pulse is applied to row 1. The lit pixels therefore achieve a pixel voltage of 200−(−25)=225 volts which exceeds the threshold voltage by 40 volts and the dark pixels achieve a pixel voltage of 200−25=175 volts which is below the threshold voltage of 185 volts. Once this row pulse returns to zero volts, the columns are set for row 2 and another +200 volt row pulse is applied to row 2. This is repeated until all N rows have received a +200 volt row pulse. This is one frame, and constitutes the second half of the addressing sequence. Now the entire sequence is complete and it begins again immediately to retain the perception by the viewer of a constant image on the EL display. The lit pixels thereby remain lit since the lit pixel voltage reaches +225 volts and −225 volts during two consecutive frames, and the dark pixels remain dark since the dark pixel voltages do not exceed +175 volts and −175 volts during two consecutive frames. In order to prevent the human eye from perceiving the individual addressing steps, approximately 60 frames per second or more must be achieved. At lower frame rates, flicker will become apparent, and also display brightness will suffer. This implies that not very much time is available to address any given row of pixels. For a VGA display, for example, with a frame rate of 60 per second, there are 16667 microseconds available per frame. Since there are 480 rows that are addressed once per frame, there are 16667÷480=34.7 microseconds available to address each row. The column electrodes must be given enough time to reach the desired ±25 volt levels and then the row electrode must reach the required ±200 volt level and return to 0V within the 34.7 microseconds available.

Therefore, as the number of rows on a display increases, and for higher frame rates, the time required to set these column and row voltages becomes a fundamental constraint in display design and performance. Referring to FIGS. 1(*a*) and 1(*b*), it is clear that the EL structure is inherently capacitive in nature, and that from a circuit viewpoint it is connected in series to an external voltage source by resistive elements comprising the column and row electrodes, and the internal resistance of the voltage source. This resistive-capacitive combination implies a characteristic time constant which limits the speed of movement of charges in the circuit which charge and discharge the capacitive EL structure. This limitation on speed of movement of charge increases the time required for the column electrodes to reach their operating voltage, which reduces the maximum refresh rate (and therefore brightness) available to address the panel. The problem is compounded as the size and resolution of the panel increases.

A second effect of multiplexing is that it causes undesirable power dissipation to exist in an EL display operation.

A simple parallel plate capacitor is illustrated in FIG. 3. The capacitance is calculated from the formula $C=\varepsilon_0\varepsilon_r A/d$. Here $\varepsilon_0$ is a constant, namely $8.85\times10^{-12}$ F/m and $\varepsilon_r$ is the relative dielectric constant of the medium between the plates. A is the area of the plates and d is the distance between plates. The capacitor of FIG. 3 is connected in series with a resistor in a circuit as shown in FIG. 4, which can be used to quantify how much power is dissipated. A voltage source $V_m$ is connected to a capacitor of capacitance $C_e$ by means of a resistor R. Consider $C_e$ to represent the capacitance of one pixel of an EL display, $V_m$ to be the modulation voltage which is less than the threshold voltage, and R to represent an effective circuit resistance determined by the EL driver and the resistance of the row and column electrodes of the EL display.

When a voltage $V_m$ is applied to the circuit, current flows through the resistor R, thereby dissipating energy. This energy is given by $\frac{1}{2}C_eV_m^2$. Once the voltage across $C_e$ reaches $V_m$, no further energy is dissipated, but energy $\frac{1}{2}C^eV_m^2$ is stored in the capacitor. This means that energy is dissipated during a frame, whenever pixel voltages are changing, causing the charge or discharge of pixel capacitances without generating any light output.

The power dissipation ($P_{mod}$) due to driving the columns of an EL display with a modulation voltage $V_m$ is normally the dominant power consumption of the EL display in a ¼ VGA or higher resolution panel. $P_{mod}$ is affected by the image being displayed since different images require different voltage sequences on the column electrodes. Also, in popular drive schemes as described in Ono, rows are allowed to "float" rather than being clamped at 0 volts when not being supplied with a positive or negative voltage; A "worst case" value of $P_{mod}$ is calculated to determine the maximum power that can be dissipated. This power becomes, for example, $P_{mod}=\frac{1}{4}N\ f\ C_p\ V_m\mathbf{2}$ for the p-p symmetric drive method (Ono P110). Here, $C_p=NMC_e$ is the total EL display capacitance, f is the number of frames per second, N is the number of rows in the display, M is the number of columns, and $V_m$ is the modulation voltage supplied by the column drivers.

On page 110, Ono shows the components of power that are dissipated in a typical VGA format monochromatic EL display. The results show that over 12 watts of power can be dissipated in a VGA EL display just charging and discharging column voltages. Since the overall power dissipation in the entire display is under 16 watts, it is clear that over 75% of the overall power is being used for charging and discharging column voltages in the example illustrated.

A further difficulty arises in addressing an EL display. A column voltage swing is accompanied by electric current flowing to the addressed pixels. Since only microseconds of time are available between each row address, the charge must flow fast to charge up those pixels, for example, that are at the end of the columns remote from the driver connection, resulting in large electrical currents. This requires high current column drivers, which are expensive, and also requires that column electrodes must be sufficiently conductive to handle the large electrical currents. However, as column electrodes are made to be more conductive, by increasing thickness for example, it is increasingly difficult to maintain them optically transparent to allow the light to come out of the display. Highly conductive bus bars have been proposed to increase column conductivity, but these structures add cost and also reduce optical efficiency. Employing bus bars also further increases the peak current demands on the column drivers, thus further increasing their costs. The overall effect of the problems associated with passive matrix addressing, namely unproductive energy dissipation and limitations on refresh rate, is to limit the size and resolution of useful EL displays and to add cost to the electronic drivers.

Therefore it would be advantageous to provide an AC EL display device that reduces the aforementioned problems.

SUMMARY OF THE INVENTION

It is a first object of this invention to reduce power dissipation in charging and discharging pixels by column voltages during multiplexing of an EL display.

It is a second object of this invention to reduce the current required by the column drivers of a multiplexed EL display.

It is a third object of this invention to reduce the time taken to charge and discharge the EL capacitance structure via the column electrodes.

If, for a given size and resolution the power dissipation in charging and discharging column electrodes can be reduced, and the current flow in the column drivers and electrodes can be reduced, then EL displays with larger display size and values of M and N higher than currently realizable are possible. It is therefore a fourth object of this invention to enable the physical size and/or the number of rows and columns in a practical EL display to be larger than with conventionally addressed EL panels.

The present invention provides a multiplexed matrix alternating current electroluminescent display, comprising:

an array of matrix addressed capacitively switchable electroluminescent pixels, each capacitively switchable electroluminescent pixel including an electroluminescent pixel and a circuit element connected in electrical series with said electroluminesent pixel, said circuit element being switchable between an electrically insulating capacitive state and an electrically conducting state depending upon a voltage applied across said capacitively switchable electroluminescent pixel; and power supply means connected said array of matrix addressed capacitively switchable electroluminescent pixels for providing power to each capacitively switchable electroluminescent pixel.

In this aspect of the invention the capacitively switched circuit element may have a capacitance in the capacitive state that is substantially equal to, or less than, the capacitance of the EL pixel. In this aspect the capacitance of the capacitively switched circuit element in the capacitive state may be in a range of from about 1 to about 1,000,000 times less than the capacitance of the EL pixel.

The capacitively switched circuit element may be a solid state dielectric or a gas which functions as a capacitor in a selected voltage range and a conductor outside of the selected voltage range.

BRIEF DESCRIPTION OF THE DRAWINGS

The EL display constructed in accordance with the present invention will now be described, by way of example only, reference being had to the accompanying drawings, in which:

FIG. 1(*b*) is a cross-sectional view of the PRIOR ART structure of a standard AC thin-film EL device pixel of FIG. 1(*a*);

FIG. 5(*b*) shows the current-voltage characteristic of a symmetric switching circuit element;

FIG. 6(*b*) shows a structure of an AC thin film EL pixel with switching element;

FIG. 6(*c*) shows a structure of the AC thin film EL pixel with the switching element, and without an inner electrode;

FIG. 6(*d*) shows a structure of the AC thin film device with the switching element where the switching element is a fluid such as a gas;

DETAILED DESCRIPTION OF THE INVENTION

According to the present invention, a matrix addressed alternating current electroluminescent (EL) display comprises capacitively switchable EL pixels which include circuit elements connected in series with EL pixels in the EL display. The overall goal of the present invention is to provide a matrix addressed EL display which permits larger EL pixel arrays (larger number of pixels and/or larger surface area covered by pixels) to be addressed. The present invention achieves this by incorporating into each EL pixel at least one circuit element which can be switched between a state in which it functions as a capacitor and a state in which it functions as a conductor depending on the voltage applied across the circuit element. Below a threshold voltage the circuit element is in the capacitive state and in the conducting state when voltages above the threshold are applied. When in the capacitive state, the purpose of the circuit element is to reduce the overall capacitance of the capacitively switchable EL pixel. This is achieved by ensuring the circuit element, when incorporated into each pixel element, is in electrical series with the EL pixel. The effective capacitance of two capacitors in series is always smaller than the smallest capacitance and when one of the capacitors has a very high capacitance compared to the other then the effective capacitance is nearly identical to the smaller capacitance.

Therefore, the capacitance in the capacitive state of the circuit element can range in values from greater than to much less than the capacitance of the EL pixel.

However, in preferred embodiments of the circuit element the capacitance of the circuit elements is in a range of from about equal to 1 to about 1,000,000 times less than the capacitance of the electroluminescent phosphor layer.

Figure 1A:
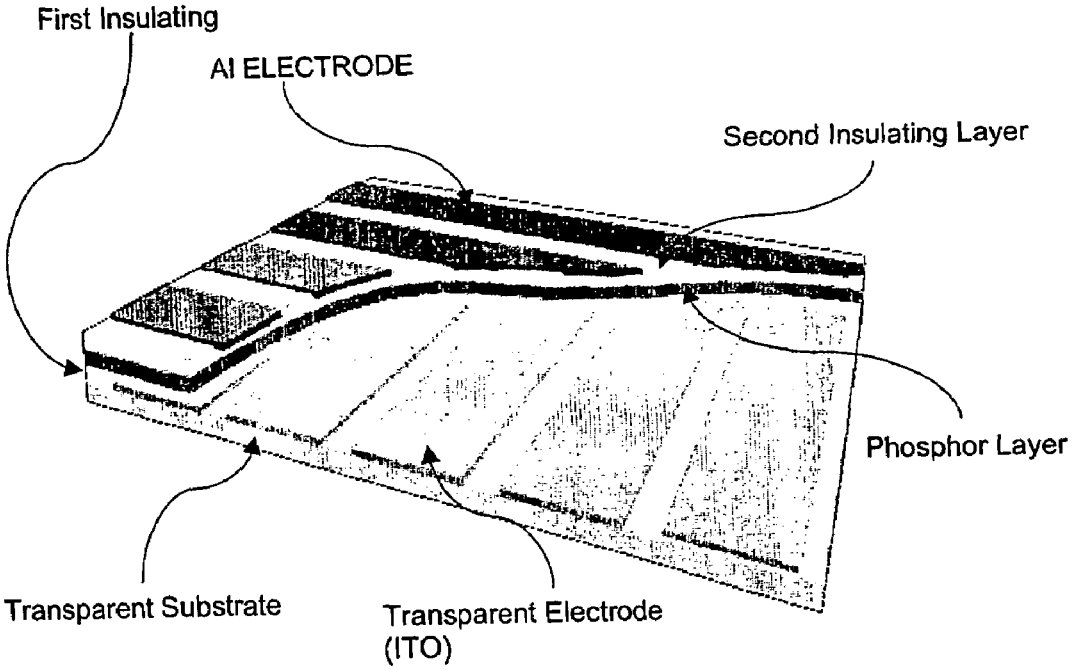
PRIOR ART Figure 1(a)
FIG. 1(*a*) shows a perspective view, broken away, of a PRIOR ART structure of a standard double-insulating-layer-type AC thin-film EL device.
Figure 1B:
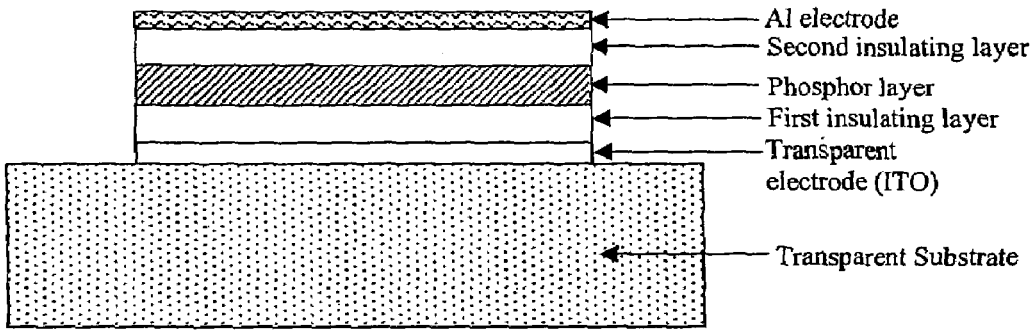
PRIOR ART Figure 1(b)
Figure 2:
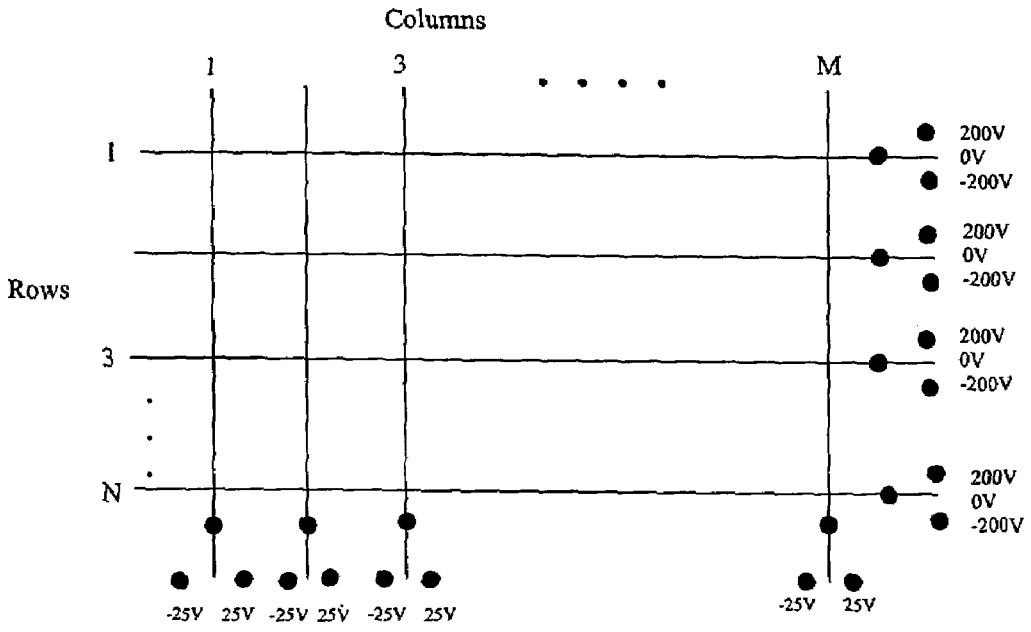
PRIOR ART Figure 2
FIG. 2 is a diagrammatic representation of a PRIOR ART EL matrix showing row/columns with applied voltages.
Figure 3:
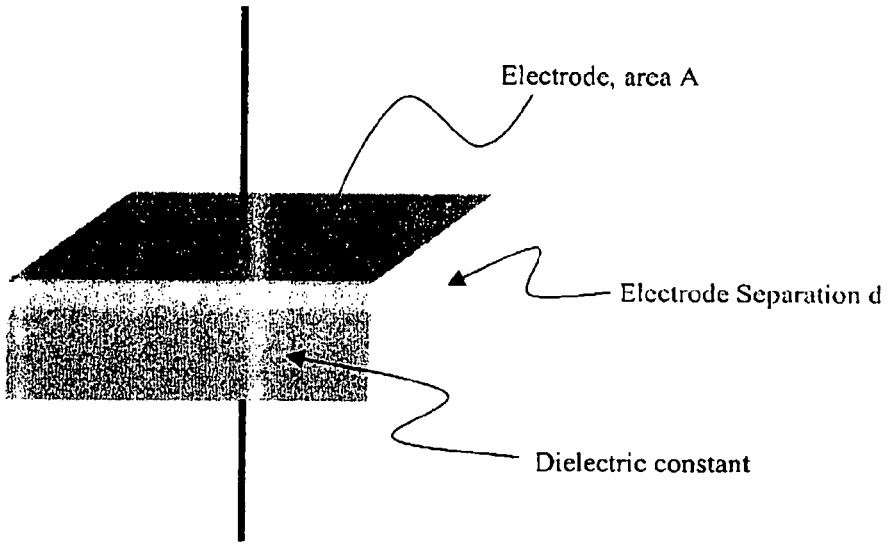
PRIOR ART Figure 3
FIG. 3 shows a PRIOR ART parallel plate capacitor.
Figure 4:
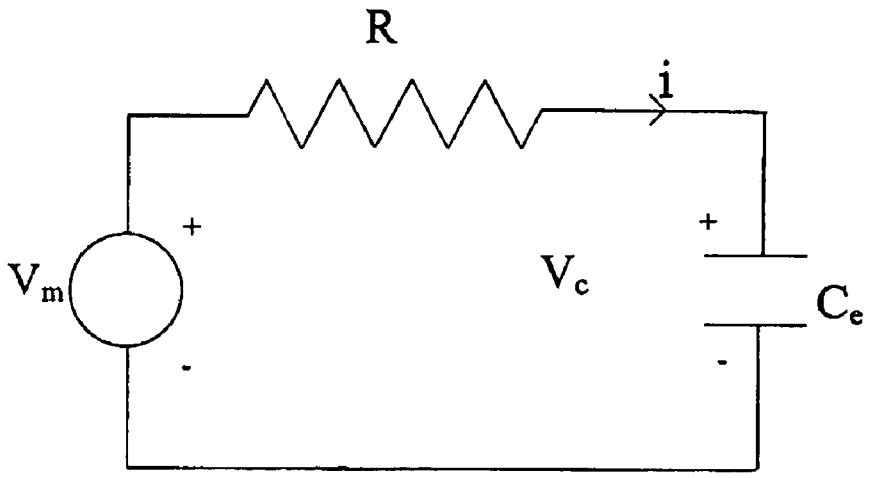
PRIOR ART Figure 4
FIG. 4 shows a PRIOR ART schematic drawing showing the charging of a series RC circuit.
Figure 5:
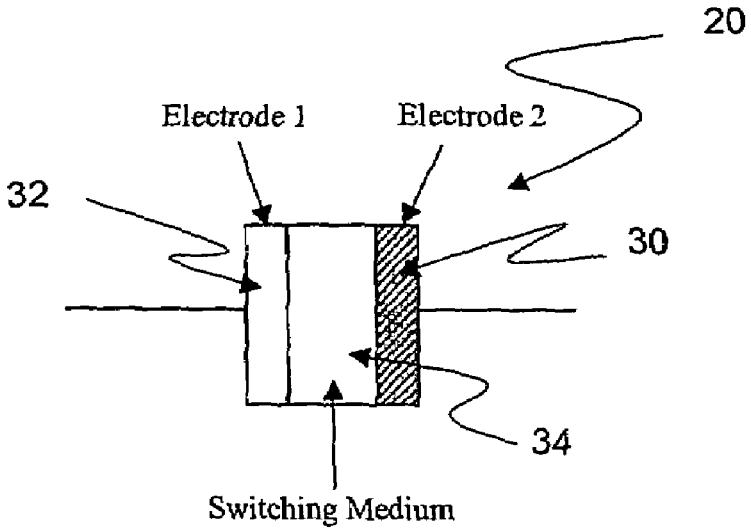
FIG. 5(*a*) shows a switching circuit element for use in accordance with the present invention.
Figure 5:
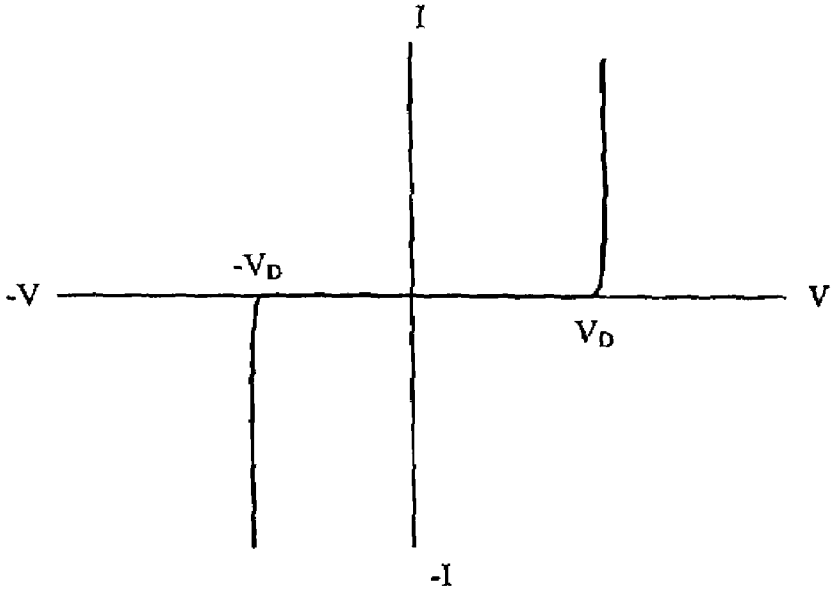

In a preferred embodiment, consider a circuit element 20 that comprises two electrodes 30 and 32 separated by a dielectric switching medium 34 is shown in FIG. 5(*a*). Note that when combined with an EL device, two electrodes are not always necessary to allow the circuit element to function. This dielectric switching medium 34 is an insulator at low voltages, but conducts at higher voltages. For example, in one embodiment of a circuit element, if the difference in voltage between the electrodes is 25 volts or less, the medium 34 is an insulator. If this voltage difference rises above 25 volts, the medium 34 becomes conductive, but it again becomes insulating if the voltage difference subsequently falls below 25 volts (see FIG. 5(*b*) for an idealized current voltage characteristic). We therefore call this dielectric medium 34 a dielectric switching medium. The choice of 25 volts is by way of example only.

The circuit element 20 has capacitance $C_s$ for voltage differences below 25 volts, and according to the invention $C_s$ is small, compared with the EL pixel capacitance $C_e$, which may be achieved both by choice of EL pixel materials and dielectric switching materials, and by the thicknesses and areas of the capacitive switching circuit element and the EL pixel.

Figure 6:
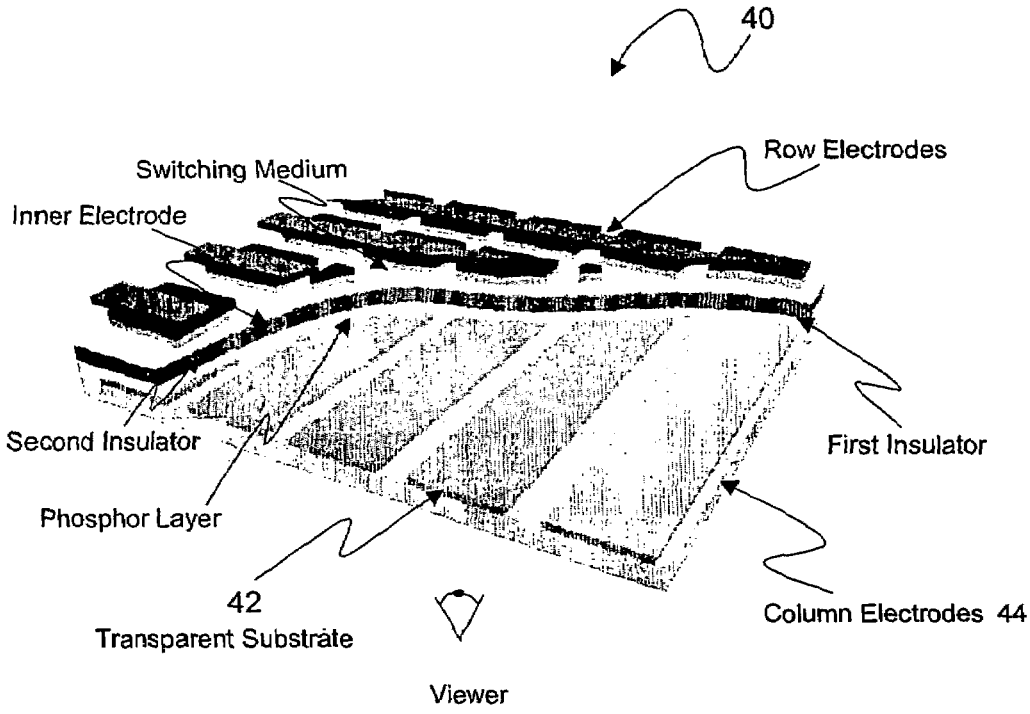
FIG. 6(*a*) shows a structure of a double insulating-layer-type AC thin-film device with switching circuit elements.
Figure 6:
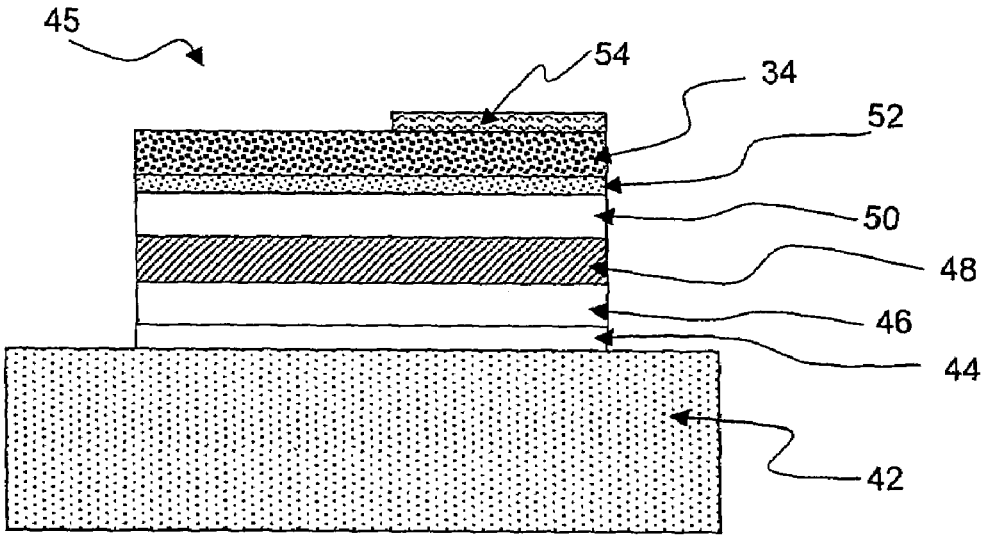
Figure 6:
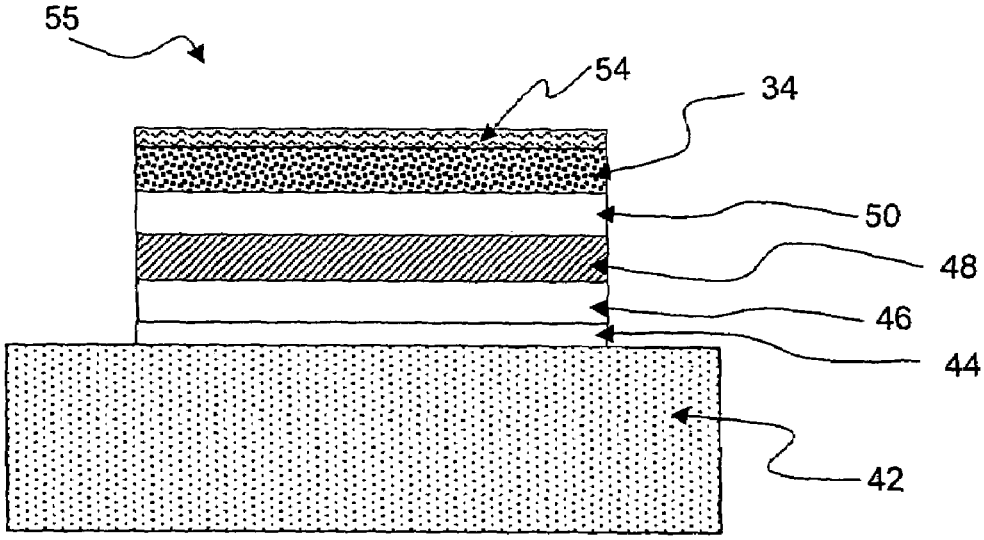
Figure 6D:
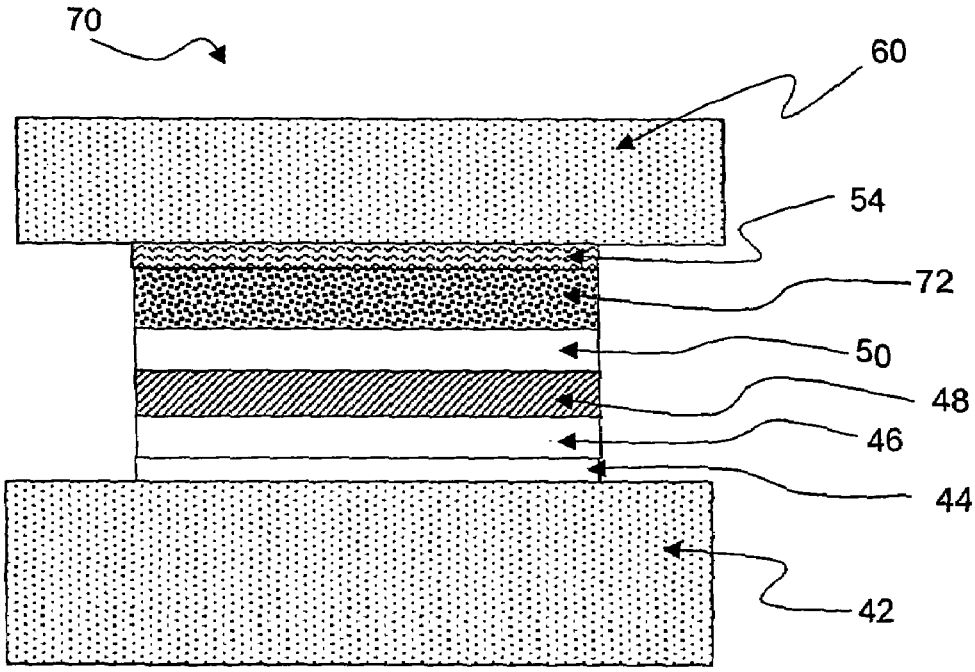

Referring to FIGS. 6(*a*) and 6(*b*), a perspective view of an illustrative example of a matrix addressed EL display is shown generally at 40 in FIG. 6(*a*) and the corresponding cross sectional view of an individual capacitively switchable EL pixel is shown generally at 45 in FIG. 6(*b*). Parallel stripes of a transparent electrode material (e.g. indium tin oxide) are deposited onto a transparent substrate 42 (e.g. glass) to form column electrodes 44. A first electrically insulating layer 46 is deposited on top of the column electrodes 44 and the EL phosphor layer 48 is deposited on top of the insulating layer 46. A second insulating layer 50 is then coated on top of EL phosphor layer 48. A plurality of inner electrode pads 52, the number being equal to the product of the number of rows and the number of columns in the display 40, are deposited on top of the second dielectric insulating layer 50, with the pads 52 being electrically isolated from each other and arranged in a matrix whose columns are disposed vertically above the column electrodes 44. The dielectric switching medium 34 is then deposited on top of the electrode pads and insulator layer 50. Finally, parallel row electrodes 52 substantially orthogonal to the column electrodes are deposited on top of the switching layers. Each of the column electrodes 44 and the row electrodes 54 are adapted to have respectively column and row driving voltages applied thereto. As shown in FIG. 6(*b*) the row electrodes do not necessarily have the same width as the EL pixel element as defined by the inner electrode pad 52. Note that in practical displays, the row electrodes and/or column electrodes do not necessarily have to be parallel, and the rows and columns do not necessarily have to be arranged orthogonal to each other.

In the embodiment of the EL display shown in FIG. 6(*b*) the inner electrode pad 52 serves principally to provide a plane of uniform electric potential above the EL phosphor layer 48. The presence of the inner electrode pad 52 is preferred in embodiments where one wants to further reduce the capacitance of the structure by employing a narrow row electrode 54 that is less than the full width of the pixel element as shown in FIG. 6(*b*). In these cases, the capacitance is defined both by the switching material 34, and by the reduced area of the rear electrode 54 as in FIG. 6(*b*). In this case, at higher operating voltages, when the switching material 34 becomes conductive, charge flows into the inner electrode 52, and the inner electrode defines the active area of the pixel element 45. In cases where the Al back electrode 54 has the same full planar surface area as the EL pixel area (the area to be illuminated), the inner electrode pad 52 is not necessarily required to define the area of the pixel element that is illuminated, and therefore pad 52 may be eliminated.

FIG. 6(*c*) shows an illustrative example of a side view of a capacitively switchable EL pixel at 55 where the rear row electrode 54 covers the full surface area of the EL phosphor 48 so that a uniform electric field is developed across the full phosphor layer 48. In this case the inner electrode layer 52 of FIG. 6(*b*) is eliminated from the structure.

A fluid such as a gas may be used as a switching medium. In these cases, the rear electrode must be supported by some means behind the EL structure to create a gap where the fluid medium can reside. This gas may be excited into a plasma upon application of a sufficient electric field.

FIG. 6(*d*) shows an illustrative example of a side view of a capacitively switchable EL pixel 70 where a fluid gas/plasma switching medium 72 is employed. In this case, the rear electrode 54 is supported behind the EL pixel element by applying the electrode 54 to a second sheet of substrate material 60, and supporting the second substrate layer 60 behind the front substrate 42. In this case, the rear substrate 60 provides a means to support the rear electrode 54 and a means to enclose the fluid switching medium 72 in the EL structure. Rear substrate 60 may be spaced from front substrate 42 by means of spacers such as ribs that are disposed within the fluid switching medium 72. Such spacers are well known in the art of flat panel plasma displays, and are not shown in FIG. 6(*d*).

Suitable thin insulating layers comprised of, for example, MgO may be disposed above and below and adjacent to the gas switching medium, the insulating layers providing resistance to bombardment of ion species due to the plasma, and lowering of the voltage necessary for the plasma to be excited, the insulating layers being well known in the art of flat panel plasma displays, not shown in FIG. 6(*d*).

Thus, in the various embodiments of the capacitively switched EL pixel 45, 55 and 70, the switching medium 34 (FIGS. 6(*b*), 6(*c*)) and 72 (FIG. 6(*d*)) is incorporated within each capacitvely switched pixel below the associated row electrode 54. Each capacitively switched EL pixel therefore has its own circuit element which is comprised of the switching medium as its active layer. As with the EL phosphor layer, in order to improve the switching characteristics in the dielectric switching layer, the latter may be sandwiched between other layers (e.g. insulating layers) to give improved charge trapping and material compatibility for example. In this case, only the dielectric switching medium switches between the conducting and capacitive states, since the presence of the two insulator layers will prevent conduction through the entire stack (insulator/dielectric switching layer/insulator).

Referring again to FIG. 6(*b*) for example, consider once again the addressing sequence, but applied to an N-row, M-column EL display with a switching medium 34 element for each pixel element. All the row voltages are set to 0 V. The M columns are set to either +25 volts or −25 volts. Now, a row voltage is applied to row 1 with a voltage of −225 volts. If a pixel of row 1 had −25 volts applied to its column, a voltage difference of −225−(-25)=−200 volts would be achieved between the row and the column at that pixel. The circuit element would immediately become conductive and a −25 volt drop would be maintained across the circuit element, leaving a further voltage of −175 volts across the EL pixel. This would mean that this pixel is in its dark state. If a pixel of row 1 had +25 volts applied to its column, a voltage difference of −225−25=−250 volts would be achieved between row and column at that pixel. The circuit element would immediately become conductive and a −25 volt drop would be maintained across the circuit element leaving a further voltage of −225 volts across the EL pixel. This means that the EL pixel emits light.

The addressing sequence now follows the same steps as described in the section, Background of the Invention. However all the row voltages are increased from +200 volts to +225 volts, for one frame, and then decreased from −200 volts to −225 volts for the second frame.

To understand the advantage of incorporating the circuit element, consider the row 1 pixel elements. Except for the pulses of ±225 volts applied to row 1, these pixels are not subjected to voltage differences of more than approximately 25 volts during the remainder of the frame, when the remaining rows in the display are addressed. In other words, during the majority of the addressing time, when rows 2 to N are being addressed, the pixel elements of row 1 are connected between row 1 which is at zero volts or floating and columns that are either +25 volts or −25 volts. In this voltage range, the circuit elements connected with the pixel elements of row 1 are not conductive, and the voltage falls predominantly across the circuit elements rather than the EL pixels because of the much lower capacitance of the circuit elements compared to the capacitance of the EL pixel. This means that little current need flow in and out of these pixels, and little power is dissipated by the column drivers. The pixel elements of row 2 are likewise not subjected to voltage differences of more than 25 volts except for the duration of the ±225 volt pulses applied to row 2, and for the majority of the addressing time they are substantially isolated from the applied voltages. By the same reasoning, all of the pixel elements are substantially isolated from the applied voltages by their associated switching circuit elements for the majority of the addressing time or frame time. Here, the overall power dissipated in columns and column drivers decreases substantially during a frame. Some power is dissipated in the circuit elements in addition to that dissipated in the circuit resistance during a row pulse, however this is not a significant amount of power compared to the power saved in the column modulation process for higher resolution EL panels. Because the circuit element has is in a capacitive state when only the modulation voltage is applied, and becomes conductive at higher applied voltages, the invention is known as capacitively switched matrix addressing. The circuit element preferably has a substantially well defined symmetric switching voltage, such voltage being larger than the peak voltages applied to the column electrodes.

Therefore, the present invention combining a circuit element switchable between a capacitive and a conducting state in series with each EL pixel is very advantageous over present EL systems for several reasons. Since the capacitance of the circuit element is low and in series with the EL pixel, the capacitance of the capacitively switchable EL pixel is also low and approximately equal to the capacitance of the dielectric switching medium when the latter is in its capacitive state. This in turn means that the column capacitance is reduced by the presence of the circuit elements, as is the charging time constant of the columns, thereby enabling a higher refresh rate for the entire display. A further implication is to reduce the current required to charge the columns and thereby reduce the cost of the column drivers.

The presence of the circuit elements reduces power dissipation in charging and discharging the pixel elements (capacitors) by column voltages during multiplexing of an EL display. Also, the charge required by the columns is reduced which reduces the time needed to charge and discharge the EL capacitance structure. By reducing the power dissipation and time required to charge and discharge the column electrodes, then EL displays with larger display size and values of M and N higher than currently realizable can be made.

Devices demonstrating capacitive switching behavior are well known. One such device comprises a ZnO polycrystalline material sandwiched between electrodes, and is known as a varistor, used to suppress excess voltage spikes in power supplies. When a voltage above its turn-on voltage is applied, the ZnO material becomes conductive and it returns to an insulating state below this voltage. Another similar switch comprises a tantalum oxide layer sandwiched between metal electrodes. Such switches are referred to as MIM switches or bi-directional diodes.

Thin film EL phosphor host materials, such as ZnS, SrS, $Zn_2Si_xGe_{(1-x)}O_4$, $Ga_2O_3$, $SrGa_2O_4$, $CaGa_2O_4$, to name a few, also exhibit this switching type of behavior, and are useful in certain configurations. In other words the circuit elements exhibit very similar dielectric properties to the EL phosphors but differ in that they typically do not emit light.

Another type of switch may be formed from a neon lamp in which two electrodes inserted in a sealed bulb are surrounded by a gas or gas mixture. If a voltage above a threshold voltage is applied, a plasma is created and the gas becomes conductive. These examples serve only to illustrate the diverse ways of realizing the circuit elements, and are not meant to limit the scope of the invention.

The use of switching devices in matrix addressed displays is not new. For example, MIM switches are used in liquid crystal displays, but for a purpose different from that of the present invention; principally to introduce a better defined threshold voltage so that the levels of matrixing can be increased in liquid crystal displays. Since EL displays have a well-defined threshold voltage, no such improvement is required.

Figure 7:
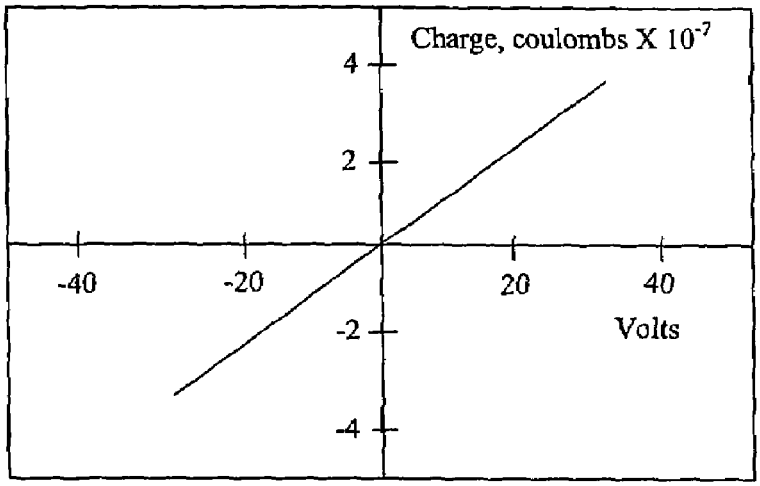
FIG. 7 shows a charge—voltage characteristic of an EL device below threshold.

To illustrate the physical principles behind the invention, a commercial varistor, Cooper Bussmann MOPVO5200EXA, was tested in conjunction with a single EL pixel in series. The EL pixel (much larger than that commonly used in a display) was 1 cm×1 cm in surface area, with a brightness-voltage behavior typical of ac thin film EL devices. The following measurements were made. The EL pixel was first measured without a varistor. The pixel was subjected to an AC voltage consisting of 200 microsecond pulses at a frequency of 60 Hz. The voltage of the pulses was set to 150 volts peak, which is below the threshold voltage of the EL device, in this case 160 volts. The charge flowing through the circuit was plotted against the applied voltage using a technique commonly employed in measuring EL device performance (Ono page 36). The result is shown in FIG. 7. Since the vertical axis is charge Q and the horizontal axis is voltage V, the capacitance C of the EL device may be determined using the well known relationship C=Q/V which is simply the slope of the line in FIG. 6. In this manner, the value of capacitance is determined to be $11.8\times10^{-9}$ Farads.

Figure 8:
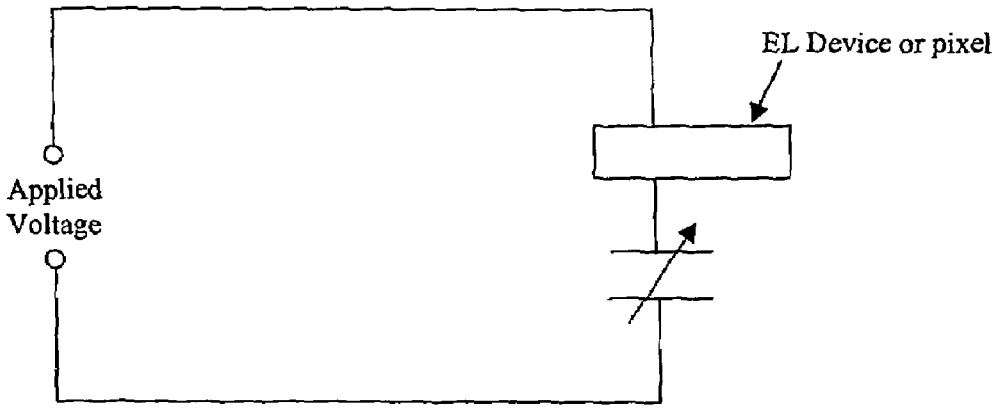
FIG. 8 shows experimental verification of EL device combined with switching device.
Figure 9:
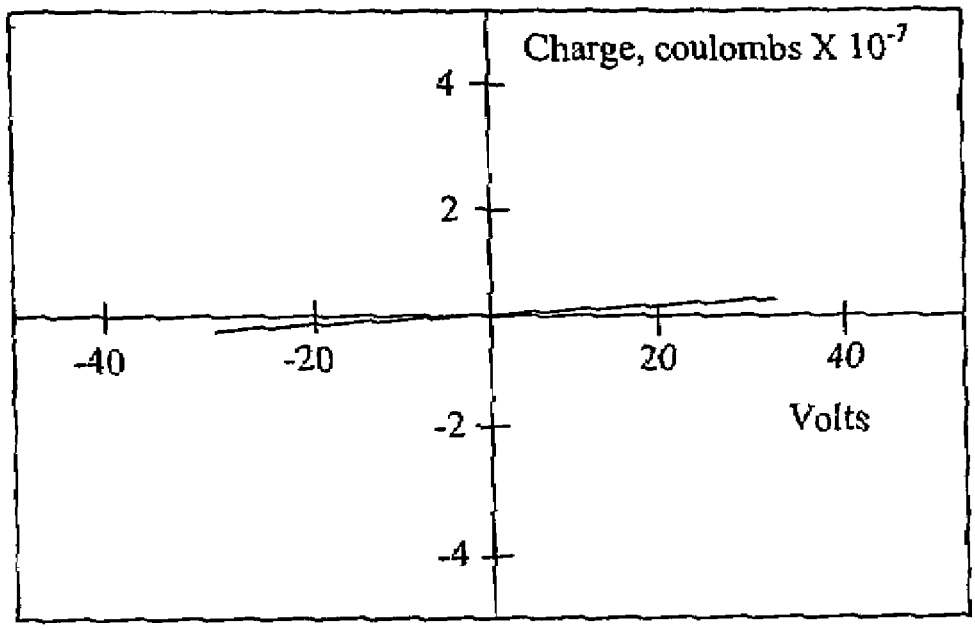
FIG. 9 shows a charge-voltage characteristic of EL-varistor combination below varistor conduction threshold.

Next, the same EL device was connected in series with the varistor according to the diagram in FIG. 8. Once again the charge was plotted against the applied voltage in FIG. 9. Voltage was 28 volts peak. Note that there is almost no charge flowing, because the varistor has not quite reached its threshold voltage which for the test device was found to be 31 volts. Therefore the capacitance of the compound EL device and varistor in series is very small as indicated by the almost zero slope of the line in FIG. 9. This is because of the small capacitance of the varistor acting as a switching circuit element. In this manner, we have shown that the capacitance of the compound EL device has been reduced dramatically by the series connection of the varistor. If each EL pixel of the EL display is connected in series with a varistor, it has therefore been demonstrated that the capacitance experienced by applied voltages is reduced provided that the threshold voltage of the varistors is not exceeded.

The cases involving higher applied voltages are now described. First, the AC voltage was increased to 150 volts peak, and applied to the EL device without a varistor in series. The voltage is below the EL threshold voltage of 160 volts. No light output was observed. When the applied voltage was increased to 190 volts peak, which exceeds the EL threshold, light emission was observed. Its measured brightness was 107 candelas per square meter.

Finally, higher applied voltages were applied to the series connected EL device and varistor according to FIG. 8. At a voltage of 181 volts peak, the voltage was not sufficient to turn on the EL device. When the applied voltage is increased to 221 volts peak, light was observed from the EL device. Its measured brightness was 107 candelas per square meter.

Note that these higher voltages applied to the test devices are equivalent to the times during the EL display addressing cycle when the row voltage corresponding to a pixel element is turned on, and the results confirm that the addressing sequence as discussed in this disclosure will result in an addressed EL display. The requirement is that the row voltages are increased by the threshold voltage of the circuit element (in this case 31 volts) compared to the EL display without the switching devices.

The drawing of FIG. 6(*a*) shows discrete circuit elements above the EL pixels in the EL display. It will be appreciated by those skilled in the art that a variety of alternative structures are possible. For example, the inner electrode of FIG. 6(*a*) may be eliminated as the switching behavior of the switching medium and the second insulating layer may not require this electrode. In another embodiment, the switching medium could be a continuous layer and switching behavior would occur as determined by the locations of electrodes in the EL display.

In a further embodiment, there are variations in the literature describing EL devices with only a second insulating layer rather than both a first and second insulating layer. The scope of the invention includes this type of EL device. In another embodiment, the inner electrodes could be as shown in FIG. 6(*a*), however the switching medium could be reduced in area to contact only a part of the area of the inner electrodes.

In another embodiment, the inner electrodes could be as shown in FIG. 6(*a*), and the switching medium could be applied in a uniform sheet to form a continuous layer. However the row electrodes could be made narrow such that they only cover a portion of the area of each inner electrode.

In still further embodiments of the present invention, EL displays may be produced in which the structure is reversed from that shown in FIGS. 6(*a*) and 6(*b*) so that emitted light is transmitted upwards rather than downwards, and the substrate may therefore be opaque while the row electrodes 54 are transparent. In such a display, the circuit elements 20 may be incorporated in the same place in the pixel element stack as shown in FIG. 6(*b*) if they are substantially transparent and if not they may be located between the EL phosphor layer 48 and column electrodes 44. Alternatively, the circuit element could be disposed between the first electrode and the EL phosphor layers.

Figure 10A:
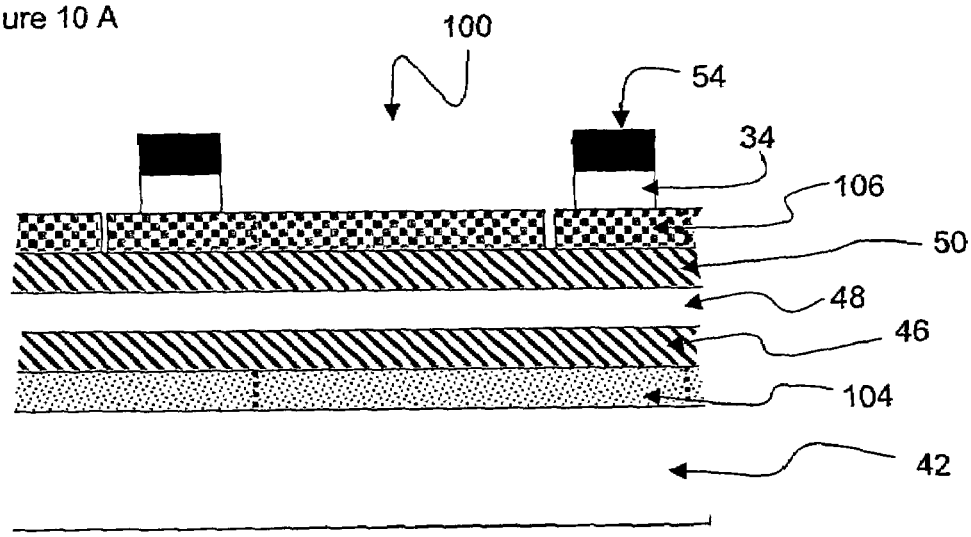
FIG. 10A shows a side cross sectional view of part of an alternative embodiment of an EL display pixel constructed in accordance with the present invention having reduced area electrodes with a dielectric switching layer.
Figure 10B:
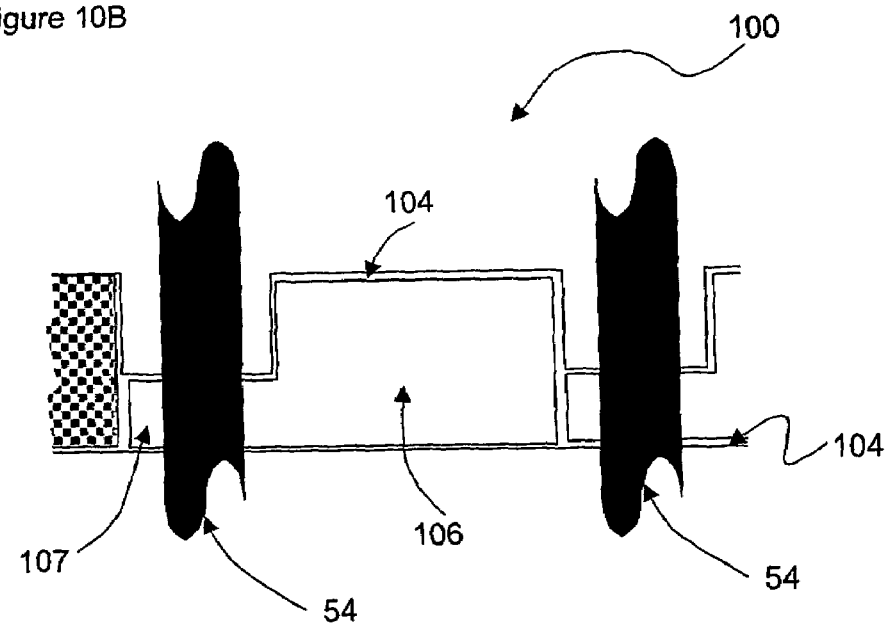
FIG. 10B shows a top view of the alternative embodiment of FIG. 10A.
Figure 10C:
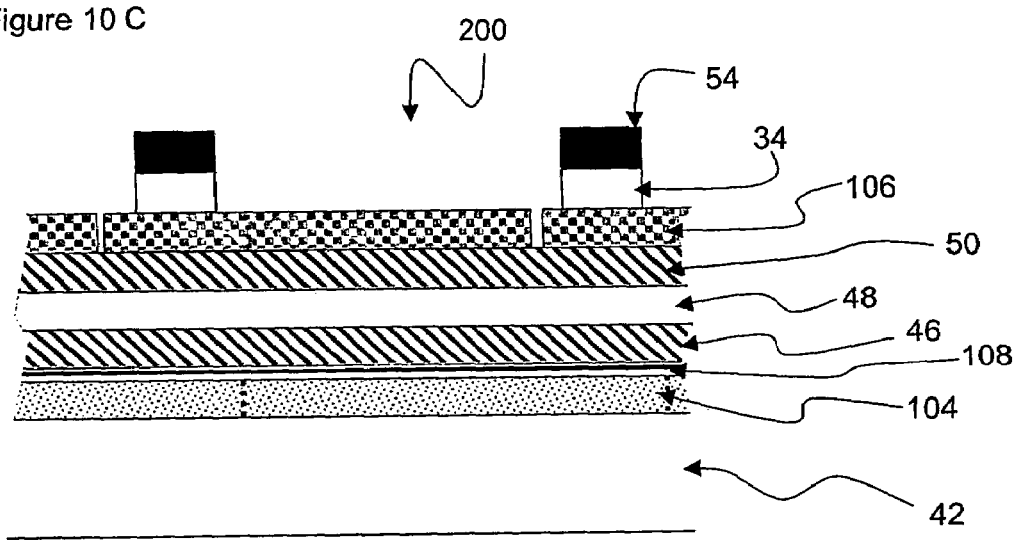
FIG. 10C shows a side cross sectional view of part of another alternative embodiment of an EL display pixel having row and column electrodes and the capacitive switching layer having a reduced area and a high conductivity stripe for conductivity enhancement.
Figure 10D:
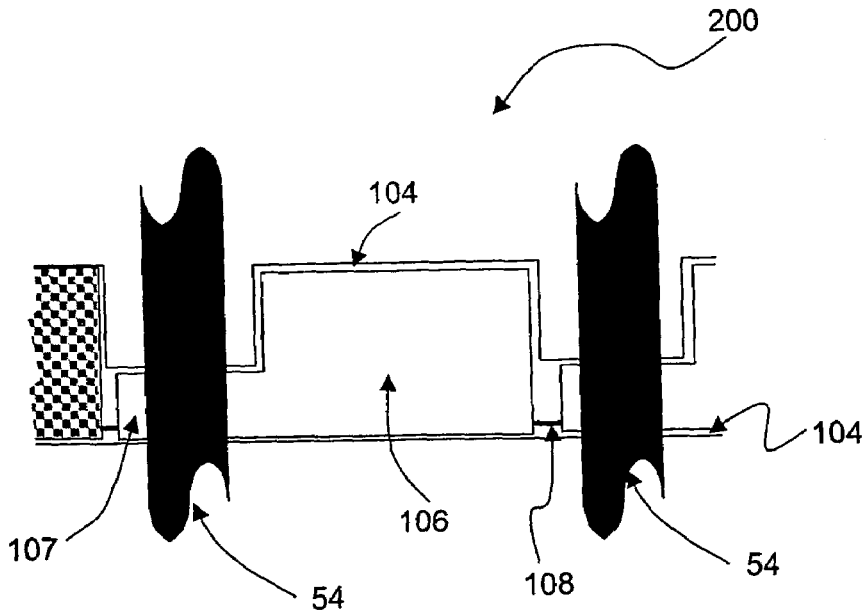
FIG. 10D shows a top view of the embodiment of FIG. 10C showing reduced area electrodes with switching layer and conductivity enhancement.

In other embodiments, the capacitance of the circuit element may be further lowered compared to the structure shown in FIG. 6(*a*) by constructing the device 100 shown in FIGS. 10A and 10B. The geometry of the row electrodes 54 and the column electrodes 104, and the inner electrode pad 106 is modified to reduce the interactive area between the row electrode 54 and the inner electrode pad 106, and between the row electrode 54 and the column electrode 104. The geometry is modified by forming a tab 107 on the inner electrode pad 106 and arranging the narrowed row electrode 54 to pass above the tab 107, and the column electrodes 104 to be narrowed under the tab 107 (best seen in FIGS. 10B and 10D). The performance of the EL display device can be further improved as shown in the display device 200 in FIGS. 10C and 10D by forming a highly conductive strip 108 or bus bar along the transparent ITO electrode 104 to improve the conductivity of the electrode.

In a further embodiment of the present invention, a second circuit element and inner electrode pad could be incorporated, such that both the row and column electrodes are capacitively isolated from the EL phosphor layer.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A multiplexed matrix alternating current (AC) electroluminescent display, comprising:

an array of matrix addressed capacitively switchable electroluminescent pixels, each capacitively switchable electroluminescent pixel including an electroluminescent pixel having an EL threshold voltage across said electroluminescent pixel and a circuit element connected in electrical series with said electroluminesent pixel, said circuit element being switchable at a first threshold voltage across said circuit element between an electrically insulating capacitive state and an electrically conducting state when a magnitude of an AC voltage applied across said capacitively switchable electroluminescent pixel is such that a voltage drop across said circuit element reaches said first threshold voltage, wherein each capacitively switchable electroluminescent pixel exhibits a first capacitance when the magnitude of the AC voltage applied across said capacitively switchable electroluminescent pixel is such that the voltage drop across said circuit element is less than said first threshold voltage and substantially no EL light emission occurs, and when the magnitude of the AC voltage applied across said capacitively switchable electroluminescent pixel is such that the voltage drop across said circuit element is larger than said first threshold voltage and a voltage drop across said electroluminescent pixel is smaller than the EL threshold voltage, said capacitively switchable electroluminescent pixel exhibits a second capacitance larger than said first capacitance but with substantially no EL light emission, and when the magnitude of the AC voltage applied across said capacitively switchable electroluminescent pixel is such that the voltage drop across said electroluminescent pixel is larger than said EL threshold voltage EL light emission occurs from said capacitively switchable electroluminescent pixel; and power supply means connected to said array of matrix addressed capacitively switchable electroluminescent pixels for providing power to each capacitively switchable electroluminescent pixel.

2. The electroluminescent display according to claim 1 wherein said circuit element has a capacitance in said capacitive state that is substantially equal to, or less than, a capacitance of said electroluminescent pixel.

3. The electroluminescent display according to claim 1 wherein said circuit element has a capacitance in said capacitive state that is in a range of from about 1 to about 1,000,000 times less than a capacitance of said electroluminescent pixel.

4. The electroluminescent display according to claim 1 wherein said array of capacitively switchable electroluminescent pixels are arranged in rows and columns, and wherein each capacitively switchable electroluminescent pixel in a given row is connected to a row electrode, and wherein each capacitively switchable electroluminescent pixel in a given column is connected to a column electrode.

5. The electroluminescent display according to claim 4 wherein said circuit element is sandwiched between said electroluminescent pixel and one of said row and column electrodes.

6. The electroluminescent display according to claim 4 wherein a separate row voltage is applied to a specific row electrode, and a specific column voltage is applied to a specific column electrode, and wherein a difference of voltages applied to said row electrodes and said column electrodes is applied across the capacitively switchable electroluminescent pixel located at an intersection of said specific row and said specific column.

7. The electroluminescent display according to claim 6 wherein said circuit element is electrically insulating when the voltage across said capacitively switchable electroluminescent pixel is below a preselected threshold voltage, and wherein said preselected threshold voltage is selected to have a magnitude higher than a magnitude of a difference voltage applied to said capacitively switchable electroluminescent pixel located at the intersection of said specific row and said specific column when the lower of said row voltage and said column voltage is applied to said column electrode and said row electrode respectively.

8. The electroluminescent display according to claim 4 wherein said column electrode is formed on a surface of a substrate and an insulator layer is located on said column electrode, an electroluminescent phosphor layer being located on top of said insulator layer, and said circuit element being located on top of said electroluminescent phosphor layer, and said row electrode being located on top of said circuit element, and wherein either the row electrode and the circuit element or the substrate, the column electrode and the insulator layer are substantially transparent.

9. The electroluminescent display according to claim 4 wherein said column electrode is formed on a surface of a substrate and a an electroluminescent phosphor layer being located on top of said column electrode, and an insulator layer being located on top of said electroluminescent phosphor layer, and said circuit element being located on top of said insulator layer, and said row electrode being located top of said circuit element, and wherein either the row electrode, the circuit element and the insulator layer, or the substrate and the column electrode are substantially transparent.

10. The electroluminescent display according to claim 4 wherein said column electrode is formed on a surface of a substrate and a first insulator layer is located on said column electrode, an electroluminescent phosphor layer being located on top of said insulator layer and a second insulator layer being located on top of said electroluminescent phosphor layer, and said circuit element being located on top of said second insulator layer, and said row electrode being located on top of said circuit element, and wherein either the row electrode, the circuit element and the second insulator layer or the substrate, the column electrode and the first insulator layer are substantially transparent.

11. The electroluminescent display according to claim 8 wherein the row and column electrodes are interchanged.

12. The electroluminescent display according to claim 4 wherein said column electrode is formed on a surface of a substrate and said circuit element being located on top of said column electrode, an insulator layer is located on said circuit element, an electroluminescent phosphor layer being located on top of said insulator layer and said row electrode being located top of said electroluminescent phosphor layer, and wherein either the row electrode, or the substrate, the column electrode, the circuit element and the insulator layer are substantially transparent.

13. The electroluminescent display according to claim 4 wherein said column electrode is formed on a surface of a substrate and said circuit element being located on top of said column electrode, an electroluminescent phosphor layer being located on top of said circuit element and an insulator layer being located on top of said electroluminescent phosphor layer, and said row electrode being located top of said insulator layer, and wherein either the row electrode and the insulator layer or the substrate, the column electrode, and the circuit element are substantially transparent.

14. The electroluminescent display according to claim 4 wherein said column electrode is formed on a surface of a substrate and said circuit element being located on top of said column electrode, a first insulator layer is located on said circuit element, an electroluminescent phosphor layer being located on top of said first insulator layer and a second insulator layer being located on top of said electroluminescent phosphor layer, and said row electrode being located top of said second insulator layer, and wherein either the row electrode and the second insulator layer or the substrate, the column electrode, the circuit element and the first insulator layer are substantially transparent.

15. The electroluminescent display according to claim 12 wherein the row and column electrodes are interchanged.

16. The electroluminescent display according to claim 8 wherein said column electrode or said row electrode located on top of said substrate has a surface area substantially equal to a surface area of said electroluminescent phosphor layer and the other of said row electrode or said column electrode on said circuit element has a surface area substantially equal to said surface area of said electroluminescent phosphor layer.

17. The electroluminescent display according to claim 12 wherein said column electrode or said row electrode located on top of said substrate has a surface area substantially equal to a surface area of said electroluminescent phosphor layer and the other of said row electrode or said column electrode on said electroluminescent phosphor layer has a surface area substantially equal to said surface area of said electroluminescent phosphor layer.

18. The electroluminescent display according to claim 13 wherein said column electrode or said row electrode located on top of said substrate has a surface area substantially equal to a surface area of said electroluminescent phosphor layer and the other of said row electrode or said column electrode on said insulator layer has a surface area substantially equal to said surface area of said electroluminescent phosphor layer.

19. The electroluminescent display according to claim 14 wherein said column electrode or said row electrode located on top of said substrate has a surface area substantially equal to a surface area of said electroluminescent phosphor layer and the other of said row electrode or said column electrode on said second insulator layer has a surface area substantially equal to said surface area of said electroluminescent phosphor layer.

20. The electroluminescent display according to claim 9 wherein a conductive pad is located between said circuit element and said insulating layer.

21. The electroluminescent display according to claim 14 wherein a conductive pad is located between said circuit element and said first insulating layer.

22. The electroluminescent display according to claim 10 wherein a conductive pad is located between said circuit element and said second insulating layer.

23. The electroluminescent display according to claim 8 wherein a conductive pad is located between said circuit element and said electroluminescent phosphor layer.

24. The electroluminescent display according to claim 20 wherein the surface area of said row electrode or said column electrode adjacent to the circuit element is substantially lower than the surface area of said electroluminescent phosphor layer.

25. The electroluminescent display according to claim 1 wherein said circuit element is a layer of solid material having selected dielectric properties.

26. The electroluminescent display according to claim 25 wherein said layer of solid material is a dielectric material which functions as a capacitor when an electric field in a selected range of electric field strengths is applied across said layer and as a conductor when an electric field having an electric field strength outside of said selected range of electric field strengths is applied across said layer.

27. The electroluminescent display according to claim 26 wherein said dielectric material is selected from the group consisting of ZnS, SrS, $Zn_2Si_xGe_{(1-x)}O_4$, $Ga_2O_3$, $SrGa_2O_4$ and $CaGa_2O_4$.

28. The electroluminescent display according to claim 1 wherein said circuit element includes a fluid switching medium which is electrically insulating when a voltage below a threshold voltage is applied across said switching medium and electrically conducting when a voltage above said threshold is voltage applied across said switching medium.

29. The electroluminescent display according to claim 28 wherein said fluid switching medium is a gas.

30. The electroluminescent display according to claim 1 wherein said circuit element is a first circuit element, and wherein said electroluminescent display includes a second circuit element incorporated therein.

31. The electroluminescent display according to claim 1 wherein said circuit element has selected dimensions including length, width and thickness, a selected relative dielectric constant and breakdown potential to give a selected capacitance versus voltage characteristic.

32. The electroluminescent display according to claim 25 wherein said solid layer is sandwiched between insulating layers.

33. The electroluminescent display according to claim 28 wherein said fluid switching medium is sandwiched between insulating layers.

* * * * *